United States Patent [19]

Chen

[11] Patent Number: 4,637,139

[45] Date of Patent: Jan. 20, 1987

[54] AMPOULE CUTTER

[76] Inventor: Fu Chen, No. 3, Alley 81, Lane 10, Sec. 2, Chang Ping Road, Taichung, Taiwan

[21] Appl. No.: 679,507

[22] Filed: Dec. 7, 1984

[51] Int. Cl.[4] ..... B26B 3/00

[52] U.S. Cl. ..... 30/164.9; 30/1.5; 81/3.31; 241/99; 225/99

[58] Field of Search ..... 30/16, 30, 1.5, 164.9; 81/3.31; 241/99; 225/93, 103

[56] References Cited

U.S. PATENT DOCUMENTS

| | | | |
|---|---|---|---|
| 543,224 | 7/1895 | Walker | 81/3.31 |
| 2,447,988 | 8/1948 | Pierson | 30/164.9 |
| 2,503,517 | 4/1950 | Sirica | 241/99 X |
| 2,508,696 | 5/1950 | Thompson | 30/164.9 X |
| 4,226,376 | 10/1980 | Pfleger | 225/93 X |

FOREIGN PATENT DOCUMENTS

| | | | |
|---|---|---|---|
| 749091 | 5/1956 | United Kingdom | 30/164.9 |

*Primary Examiner*—E. R. Kazenske
*Assistant Examiner*—W. Fridie
*Attorney, Agent, or Firm*—Leonard Bloom

[57] ABSTRACT

An ampoule cutter has a pair of shells into which the tip of an ampoule may be inserted. When inserted, the neck of the ampoule is received within the V-notch of a blade carried within the cutter. The ampoule may be rotated to score the neck of the ampoule and then snapped off.

8 Claims, 6 Drawing Figures

AMPOULE CUTTER

FIELD OF THE INVENTION

The present invention relates to devices used to open common glass ampoules, and more particularly, to ampoule opening devices which are protective of the users hands, reliable in operation, and simulative of a common glass ampoule.

BACKGROUND OF THE INVENTION

In the medical and allied health professions, glass ampoules are used to package single doses of sterile medications. Most often, these medications are administered orally or by injection.

The conventional glass ampoule has a cylindrical body and a substantially conical tip, the tip being joined to the body by a relatively-narrow neck. The narrowest portion of the neck is somewhat less in diameter than either the cylindrical body or the larger end of the conical tip adjacent to the neck.

Typically, an ampoule is opened by scoring the narrowest portion of the neck with an abrasive stone or a sharp file. The body is gripped by one hand, and the tip by the other hand. Holding the scored portion of the neck away from the eyes, the user snaps the tip off of the body.

While this method of opening glass ampoules is common practice, it is frought with shortcomings, particularly in the medical area.

A box of ampoules is usually packaged with a disposable abrasive stone intended for opening the ampoules when desired. Often, the stone is small, difficult to handle, dull, and easily misplaced. When a small stone is misplaced, valuable time may be lost to the detriment of those for whom the medication was intended. A dull stone or one which is difficult to handle will produce an inferior score on the neck of the ampoule. If the score is not satisfactory, small glass fragments may be ejected from around the neck during opening. Additionally, inadequate scoring may result in unusually sharp edges around the open neck of the ampoule.

Some users, to avoid cutting of the hands and fingers in opening ampoules will wrap the ampoule in a cloth, paper towel, or the like. While this may prevent injury, wrapping and unwrapping the ampoule is time consuming. Less than cautious handling during unwrapping will lead to dropped or spilled ampoules.

Some ampoules are provided with metal seals over the neck or tip. A special tool is required to remove this seal; and if one is not handy, time may be lost in finding another.

While apparently widespread, the conventional method and apparatus for opening ampoules is inconvenient, detracts from user safety, and is somewhat inappropriate in the health care environment.

SUMMARY OF THE INVENTION

Accordingly, it is an object of the present invention to provide an ampoule cutter for opening conventional glass ampoules, wherein the device is self contained, reliable, and fast and easy to use.

It is another object of the present invention to provide an ampoule cutter which is equipped with a tool for removing metal seals sometimes used in ampoules.

It is a further object of the present invention to provide an ampoule cutter which has a distinctive appearance and is less likely to be misplaced, thereby facilitating its use.

It is a still further object to provide an ampoule opener which is suitable for use as an advertising or promotional item.

In accordance with the teachings of the present invention, a preferred embodiment of an ampoule cutter is disclosed herein which includes a pair of complementary shells, pivotably connected together and having an open and a closed position. Resilient means constantly urges the shells to their open position. Manually-releasable latching means retains the shells in their closed position during storage. When the manual latching means is released, the tip of the ampoule may be inserted between the shells, and the shells may then be closed around the ampoule tip. A blade or other scoring means is carried by at least one of the shells. The arrangement is such that the ampoule may be rotated to engage its neck against the blade, thereby scoring the neck of the ampoule. The tip then may be snapped off while held within the device.

In accordance with the further teachings of the present invention, the device includes a retractable tool or prong for removing metal seals from ampoules. This prong is slidably received within a slot provided in an axial housing extension formed integrally with one of the shells. In its retracted position within the housing, the prong engages a projection on one of the shells and provides a latch preventing a pivotal separation of the shells. In its extended position relative to the housing, the prong clears the projection, unlatching the shells, and allowing the pivotal separation of the shells under the resilient bias of a spring.

These and other objects of the present invention will become apparent from a reading of the following specification, taken in conjunction with the enclosed drawings.

GENERAL DESCRIPTION OF THE PREFERRED EMBODIMENT

Figure 1:
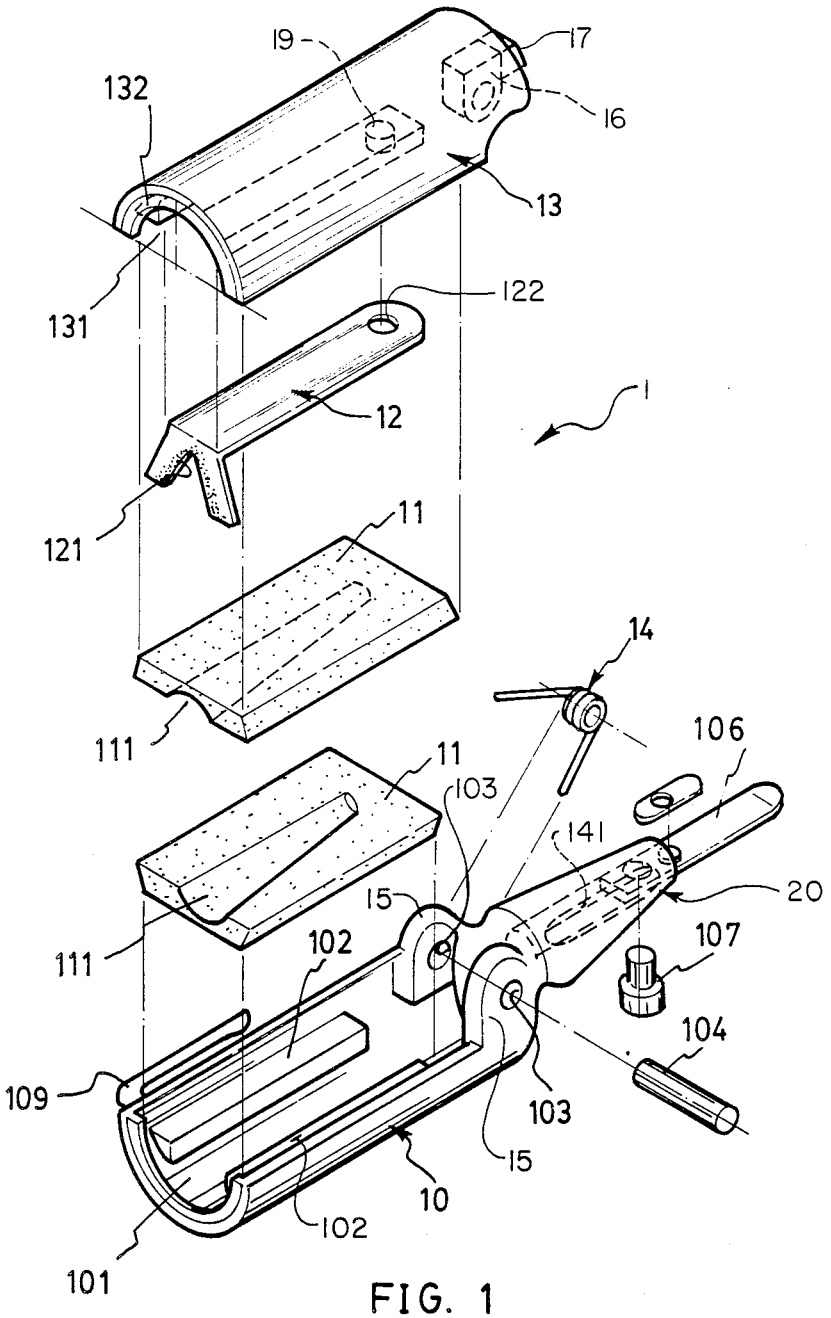
FIG. 1 is an exploded parallel projection showing the components of a preferred embodiment of the ampoule cutter of the present invention.
Figure 2:
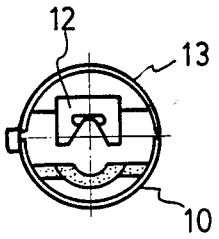
FIG. 2 is an end view of the ampoule cutter showing the end portion thereof into which the tip of the ampoule is to be inserted.
Figure 3:
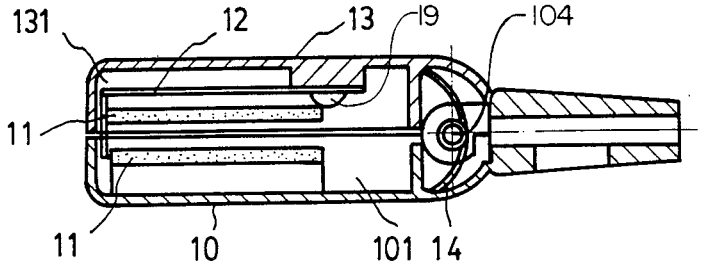
FIG. 3 is a longitudinal cross sectional view of the ampoule cutter in its closed position, taken in a plane perpendicular to the axis of the hinge between the complementary shells.

With reference to the drawings, the ampoule cutter 1 has a housing including a pair of complementary shells 10 and 13. The housing further includes a cushioning means 11, a scoring means 12, and a resilient means 14.

Figure 4:
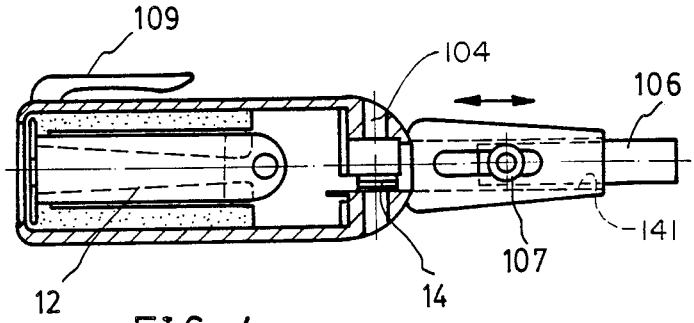
FIG. 4 is a longitudinal cross sectional view of the ampoule cutter, taken in a plane parallel to the axis of the hinge and showing the hinge, pocket clip, cushioning means, scoring means, and retractable tool.

One of the shells, 10, is formed with a clip 109, as shown more clearly in FIG. 4, thereby facilitating a convenient pocket storage. The shell 10 further includes two structural reinforcing ribs 102 defining an axial groove 101 therebetween. Hinge bosses 15 are formed integrally with the shell 10, as shown more clearly in FIG. 1, and have aligned holes 103 for receiving a hinge pin 104 therein. A substantially-conical axial housing extension 20 is formed integrally at the hinged end of the shell 10. This extension 20 provides a source of leverage for facilitating the breaking off of the ampoule tip; and with extension 20, the overall device tends to generally simulate the external appearance of a conventional glass ampoule.

Figure 5:
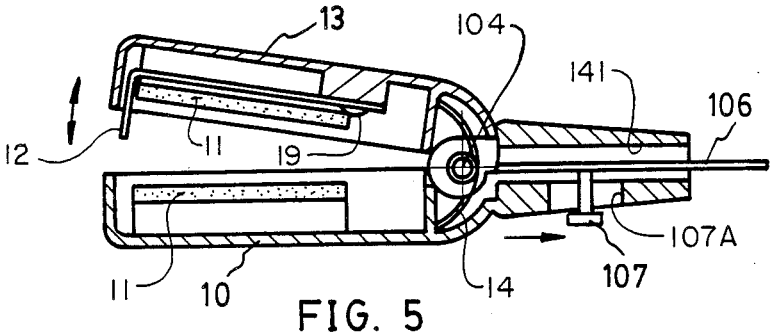
FIG. 5 corresponds substantially to FIG. 3, but shows the ampoule cutter in its open position.
Figure 6:
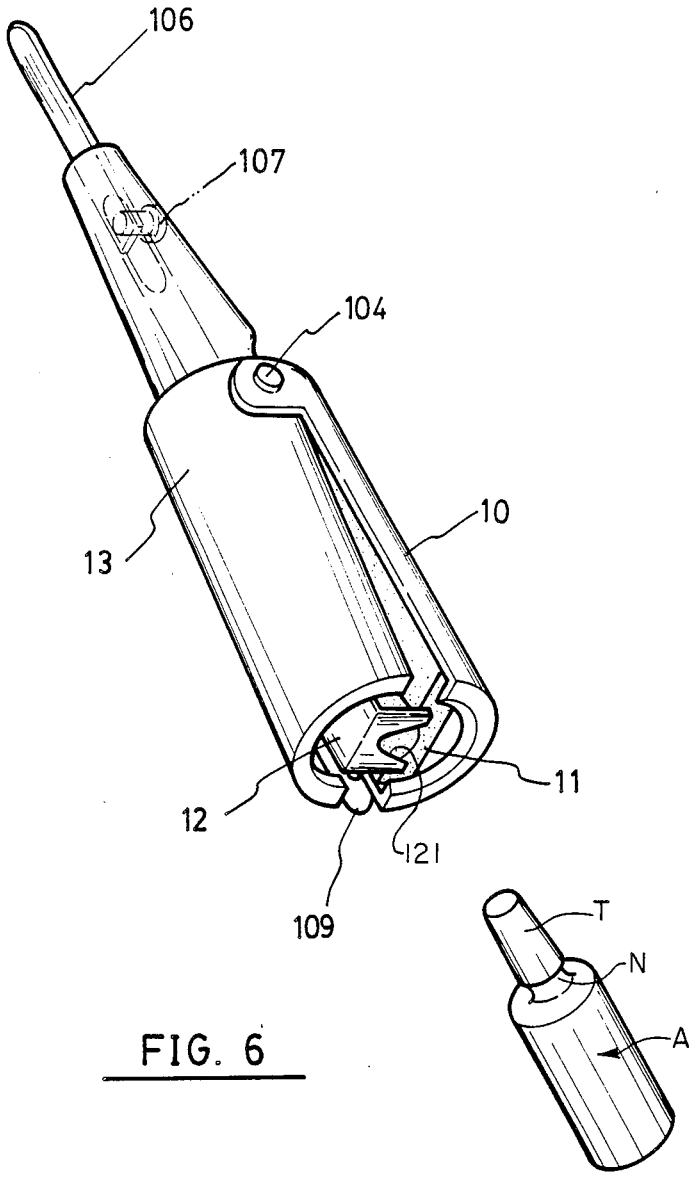
FIG. 6 is a parallel projection of the assembled ampoule cutter, showing a conventional glass ampoule prior to insertion into the ampoule cutter.

A retractable tool or prong 106 is slidably received within a slot 141 provided in the extension 20. The prong 106 carries a button 107 received in a slot 107A, as shown more clearly in FIG. 5. The button 107 retains the prong 106 and provides a means for manually extending or retracting the prong as required by the user.

The second shell 13 includes a hinge boss 16 complementary to, and adapted to be nested between, hinge bosses 15 on the first shell 10. A hinge pin 104 passes transversely through the hinge elements 15 and 16, thereby pivotably connecting the complementary shells together. The shell 13 includes a projection 17 which abuts the prong 106 when the prong is in its fully retracted position within the axial extension of shell 10. When the prong is extended, the projection 17 disengages from the prong, thereby permitting limited pivotal movement of one shell relative to the other shell about the axis of the hinge. The combination of prong 106 and projection 17 provide a means for holding the device closed for storage purposes, as for example, when the device is in the user's pocket. The shell 13 is also formed with axial reinforcing ribs 132 defining a groove 131.

A blade (or suitable scoring means) 12 is received within the groove 131 and is retained therein by means of a stud 19. This stud 19 is formed integrally with shell 13 and is received in an opening 122 in the elongated portion of the blade 12. The blade includes a "V" shaped notch 121 formed substantially at a right angle to the elongated portion coated with diamond powder or other suitable abrasive. Cushioning means 11, preferably molded from a suitable resilient material, are received within one or both of the shells. The cushioning means provides a distribution of stresses within the tip of the ampoule, when the ampoule tip is inserted within the device, and a clamping force is exerted between the shells. The cushioning means also aid in the retention of the glass tip once it is snapped off of the body of the ampoule. A tapered slot 111 is formed in each of the cushioning means to ultimately receive the tip of the ampoule.

The resilient means comprises a spring 14 inserted around the hinge pin 14. This spring 14 has leg portions engaging the respective shells to urge the shells to their open position. The device may be closed against the resilient bias of the spring, quite easily. The device may be stored in its closed position, as previously described, by fully retracting the prong 106 thereby obstructing the rotational path of the projection 17.

In operation, the device is opened and the tip T of an ampoule A is inserted between the shells. The shells are brought together, closing the device about the tip of the ampoule, such that the "V" notch 121 of the blade rests upon the neck N of the ampoule between its body and its tip T. With the device closed, the ampoule A is rotated approximately one-half of a turn to score the neck N. With the ampoule A still in the device, the tip T is broken away from the body of the ampoule with a "snap action". Releasing the clamping pressure on the device will allow the shells to separate, so that the spent tip may be removed. The device may then be reused, or closed and secured for storage by withdrawing the retractable tool prong 106. The prong, while serving a latching function for the pivoted shells, may also be used (when extended) for opening metal seals on certain types of ampoules.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. An ampoule cutter, comprising a pair of complementary longitudinally elongated shells having an open position and a closed position, each of the shells having a forward portion and a rearward portion, means for pivotably connecting the respective rearward portions of the shells together about a transverse axis, resilient means constantly urging the shells towards their open position, manually-releasable latching means for retaining the shells in their closed position against the force of the resilient means, whereby the shells will open when the latching means is released to allow an ampoule tip to be inserted between the shells, and whereby the shells then may be closed around the ampoule tip, and blade means within the shells for engaging the neck of the ampoule in the closed position of the shells, the blade means including a first elongated substantially-flat portion carried within one of the shells parallel to the longitudinal axis thereof and a second integral blade portion formed substantially at right angles to said first portion and extending toward the other of the shells, the arrangement being such that the ampoule may be rotated to engage the blade means and then snapped off.

2. The ampoule cutter of claim 1, wherein the means for pivotably connecting the shells together comprises one of the shells having a pair of spaced-apart bosses formed therein, a complementary boss formed on the other shell and nested within the pair of bosses, and a hinge pin passing through the bosses transversely thereof.

3. The ampoule cutter of claim 2, wherein the resilient means comprises a spring inserted around the hinge pin and having portions engaging the respective shells.

4. The ampoule cutter of claim 1, wherein the integral blade portion of the blade means has a V-shaped notch adapted to engage the neck of the ampoule in the closed position of the shells.

5. The ampoule cutter of claim 6, wherein the notch is coated with abrasive.

6. An ampoule cutter, comprising a pair of complementary shells having an open position and a closed position, means for pivotably connecting the shells together, resilient means constantly urging the shells towards their open position, manually-releasable latching means for retaining the shells in their closed position against the force of the resilient means, whereby the shells will open when the latching means is released to allow an ampule tip to be inserted between the shells, and whereby the shells then may be closed around the ampoule tip, and blade means within the shells for engaging the neck of the ampoule in the closed position of the shells, the arrangement being such that the ampoule may be rotated to engage the blade means and then snapped off, further including cushioning means carried by both of the shells for gripping the ampoule tip, said cushioning means each comprising a substantially planar member having a tapered slot formed therein, the respective tapered slots receiving the tip of the ampoule when the shells are closed about the ampoule.

7. An ampoule cutter, comprising a pair of complementary shells having an open position and a closed position, means for pivotably connecting the shells together, resilient means constantly urging the shells towards their open position, manually-releasable latching means for retaining the shells in their closed position against the force of the resilient means, whereby the shells will open when the latching means is released to allow an ampoule tip to be inserted between the shells, and whereby the shells then may be closed around the ampoule tip, a blade means positioned within the shells for engagig the neck of the ampoule in the closed position of the shells, the arrangement being such that the ampoule may be rotated to engage the blade means and then snapped off, and, wherein the latching means comprises an axial housing extension formed integrally with one of the shells, the housing having a slot formed therein, a prong slidable within the slot, the prong having a retracted and an extended position relative to the housing, and a projection carried by one of the shells, wherein in the retracted position of the prong, the prong engages the projection to prevent pivotal separation of the shells, thereby latching the shells in their closed position, and wherein in the extended position of the prong, the prong clears the projection, unlatching the shells, and allowig the shells to pivotably separate under the influence of the resilient means.

8. An ampoule cutter, comprising a pair of complementary shells having an open position and a closed position, one of the shells having a pair of spaced-bosses formed therein, a complementary boss formed on the other shell and nested within the pair of bosses, a hinge pin passing through the bosses transversely thereof, thereby pivotably connecting the shells together, a spring inserted around the hinge pin and having portions engaging the respective shells, thereby constantly urging the shells to their open positions, cushioning means carried by at least one of the shells, an axial housing extension formed integrally on the one shell and having a slot formed therein, a prong slidable within the slot, the prong having a retracted and an extended position, a projection carried by the other shell, wherein in the retracted position of the prong, the prong engages the projection to prevent pivotal separation of the shells, thereby latching the shells in their closed position, and wherein in the extended position of the prong, the prong clears the projection, unlatching the shells, and allowing the shells to pivotably separate under the influence of the spring, a blade carried by the other shell and having a V-notch formed therein, the notch having abrasive coated thereon, whereby when the shells are in their open position, the tip of the ampoule may be inserted within the cushioning means between the shells, such that the shells may be closed around the tip of the ampoule, and such that the neck of the ampoule may be received within the V-notch of blade, whereby the ampoule may be rotated to engage the blade notch to score the tip, and whereby the ampoule may then be snapped off.

* * * * *